US012123683B2

(12) United States Patent
Teetzel et al.

(10) Patent No.: US 12,123,683 B2
(45) Date of Patent: Oct. 22, 2024

(54) JUNCTION BOX INTERFACE FOR WEAPON ACCESSORY REMOTE CONTROL UNIT

(71) Applicant: WILCOX INDUSTRIES CORP., Newington, NH (US)

(72) Inventors: James W. Teetzel, Portsmouth, NH (US); Gary M. Lemire, Lee, NH (US); Ned A. Dalzell, Newbury, MA (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 18/228,843

(22) Filed: Aug. 1, 2023

(65) Prior Publication Data

US 2024/0035779 A1 Feb. 1, 2024

Related U.S. Application Data

(60) Provisional application No. 63/394,041, filed on Aug. 1, 2022.

(51) Int. Cl.
*F41G 5/06* (2006.01)

(52) U.S. Cl.
CPC ..... *F41G 5/06* (2013.01)

(58) Field of Classification Search
CPC ... F41G 5/06; F41G 1/35; F41G 11/00; F41A 35/00; H01R 13/533; H01R 13/621; F41C 27/00
See application file for complete search history.

(56) References Cited

U.S. PATENT DOCUMENTS 7,273,292 B2 9/2007 Kim
8,220,946 B1 * 7/2012 Teetzel ..... F41G 11/003 89/200
11,050,189 B1 6/2021 Garcia et al.
2004/0198336 A1 * 10/2004 Jancic ..... F41G 1/35 455/420
2008/0094823 A1 * 4/2008 Kim ..... F41G 1/34 362/110
2010/0157581 A1 6/2010 Galli
(Continued)

FOREIGN PATENT DOCUMENTS

EP 4317904 A1 2/2024

OTHER PUBLICATIONS

European Examination Report dated Nov. 28, 2023, received in European Patent Application No. EP23188979.1.

*Primary Examiner* — Tuyen K Vo
(74) *Attorney, Agent, or Firm* — McLane Middleton, Professional Association

(57) ABSTRACT

A junction box for a weapon accessory device is provided for electrically coupling a remote control unit to the weapon accessory device, the remote control unit having one or more manually actuatable switches. The junction box comprises a housing having a mounting face and a connection face, wherein the mounting face is configured to face a complementary mounting surface of the weapon accessory device when the junction box is mounted to the weapon accessory device. The connection face is configured to couple to an electrical cable electrically coupled to the remote control unit. A plurality of electrical conductors are held within the housing and comprise mating contact portions disposed at the mounting face and configured to contact aligned contacts on the weapon accessory device.

35 Claims, 15 Drawing Sheets

(56) References Cited

U.S. PATENT DOCUMENTS

| | | | | |
|---|---|---|---|---|
| 2016/0211095 | A1* | 7/2016 | Zimmer | H01H 9/0235 |
| 2016/0377383 | A1 | 12/2016 | Downing et al. | |
| 2019/0049221 | A1* | 2/2019 | Zimmer | F41G 11/003 |
| 2020/0143557 | A1 | 5/2020 | Zimmer | |
| 2021/0327258 | A1* | 10/2021 | Zimmer | H05K 5/0017 |
| 2022/0412696 | A1* | 12/2022 | Teetzel | F41G 11/003 |

* cited by examiner

EXEMPLARY INTERFACE

EXEMPLARY CONSTRUCTION

ALTERNATE EXEMPLARY CONSTRUCTION

JUNCTION BOX INTERFACE FOR WEAPON ACCESSORY REMOTE CONTROL UNIT

CROSS REFERENCE TO RELATED APPLICATION

This application claims the priority benefit of U.S. provisional application Ser. No. 63/394,041 filed Aug. 1, 2023. The aforementioned application is incorporated herein by reference in its entirety.

BACKGROUND

The present invention relates generally to the remote control of weapon accessories including, for example, illuminators, laser pointers, range finders, and so forth, and more particularly to a modular junction box interface and methods, apparatuses and systems employing same.

It is well known to use various accessories such as, illuminators, laser pointers, range finders, and the like mounted on weapons, such as firearms. Such accessories may have various applications, including military, law enforcement, security, and others. Commonly, weapon operators find it advantageous to mount an accessory device at a desired position on the weapon, e.g., towards the muzzle end of the weapon, and operate it remotely with controls located elsewhere, e.g., near the grip of the weapon. Many weapons also provide a plurality of accessory mounting locations, such as weapons having a quad rail interface having with top, bottom, left, and right side accessory mounting rails. Remote control units advantageously allow users to mount an accessory device at alternative locations on the weapon independently of the location of the controls. Commonly, a wired communication link is provided between a remote control unit and an accessory device. However, the lack of any standard remote control connector interface has resulted in a plethora of manufacturer-specific proprietary interfaces. Thus, a given manufacturer's remote control unit may only function with its own equipment.

The present disclosure contemplates a new junction box interface for weapon accessory remote control unit which overcomes the above-referenced problems and others.

SUMMARY

In one aspect, a junction box for a weapon accessory device is provided for electrically coupling a remote control unit to the weapon accessory device, the remote control unit having one or more manually actuatable switches. The junction box comprises a housing having a mounting face and a connection face, wherein the mounting face is configured to face a complementary mounting surface of the weapon accessory device when the junction box is mounted to the weapon accessory device. The connection face is configured to couple to an electrical cable electrically coupled to the remote control unit. A plurality of electrical conductors are held within the housing and comprise mating contact portions disposed at the mounting face and configured to contact aligned contacts on the weapon accessory device.

One advantage of the present development is that it allows various available connectors found in the market to be designed to fit into a family of "common junction boxes" that can fit into a "common receptacle" rather than the connector being installed directly into a weapon accessory device housings.

Another advantage of the present development is that it gives a manufacturer the ability to be more flexible managing supply chain issues.

Another advantage of the present development is that it may reduce manufacturing costs and simplify manufacture and assembly while providing compatibility with remote control keypads from multiple manufacturers by providing a commonality of manufacturing and assembly processes.

Another advantage of the present development is that it may provide an identical modular interface based on a common receptacle that can be designed into any number of accessory devices.

Another advantage of the present development is that it may provide end users with multiple wired and/or wireless remote control connector options, including legacy/fielded wired remotes, including legacy/fielded single and dual wired remotes for additional device activation.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention, and are not intended to limit the structure thereof to any particular position or orientation.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

The term "substantially" means that the recited characteristic, parameter, or value need not be achieved exactly, but that deviations or variations, including for example, tolerances, measurement error, measurement accuracy limitations, and other factors known to those of skill in the art, may occur in amounts that do not preclude the effect the characteristic was intended to provide.

The terms first, second, etc. may be used herein to describe various elements. These elements should not be limited by these terms, as these terms are only used to distinguish one element from another unless stated otherwise or the context clearly indicates otherwise.

Figure 1A:
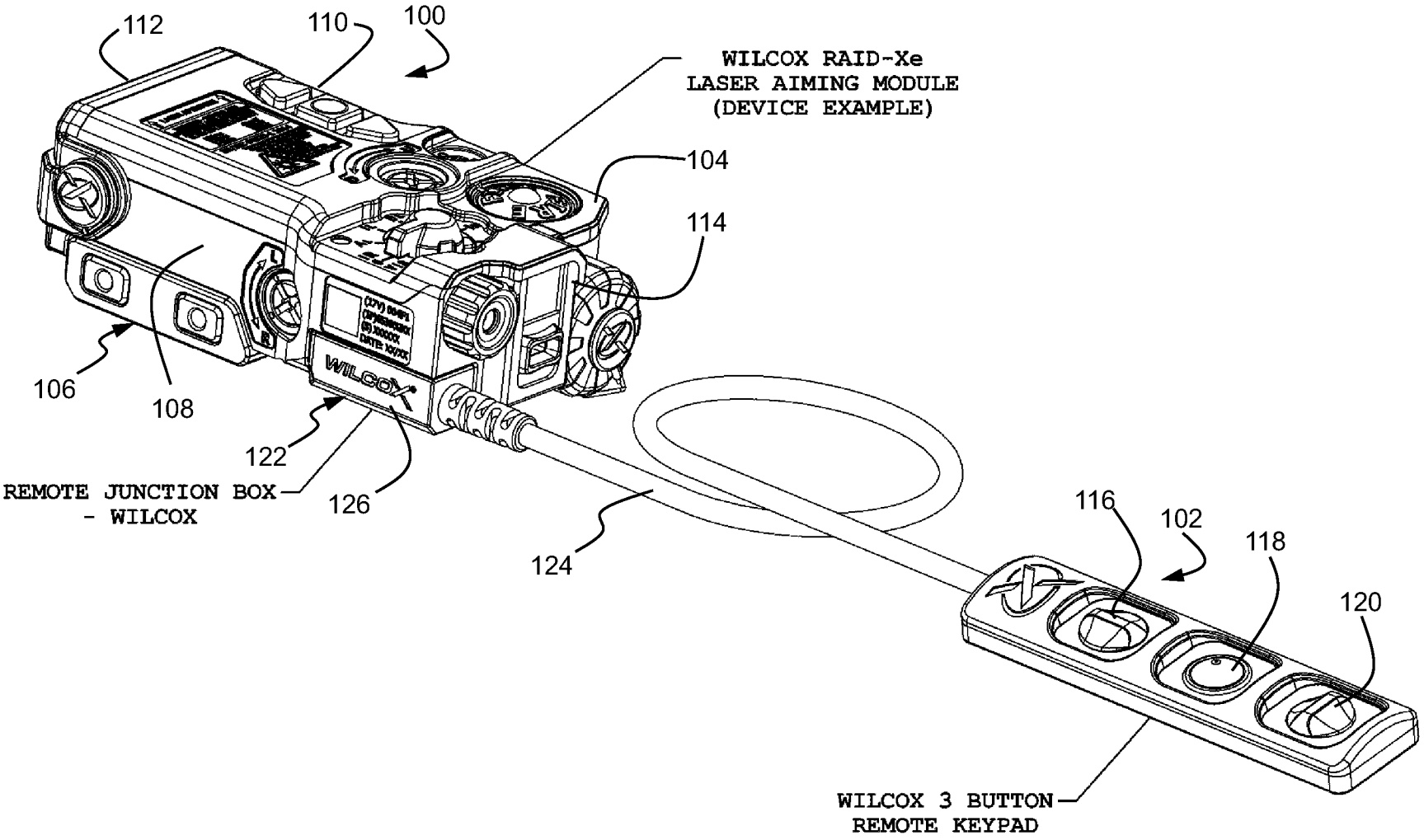
FIG. 1A is an isometric view of a weapon accessory device having a remote control junction box interface in accordance with a first exemplary embodiment.
Figure 2A:
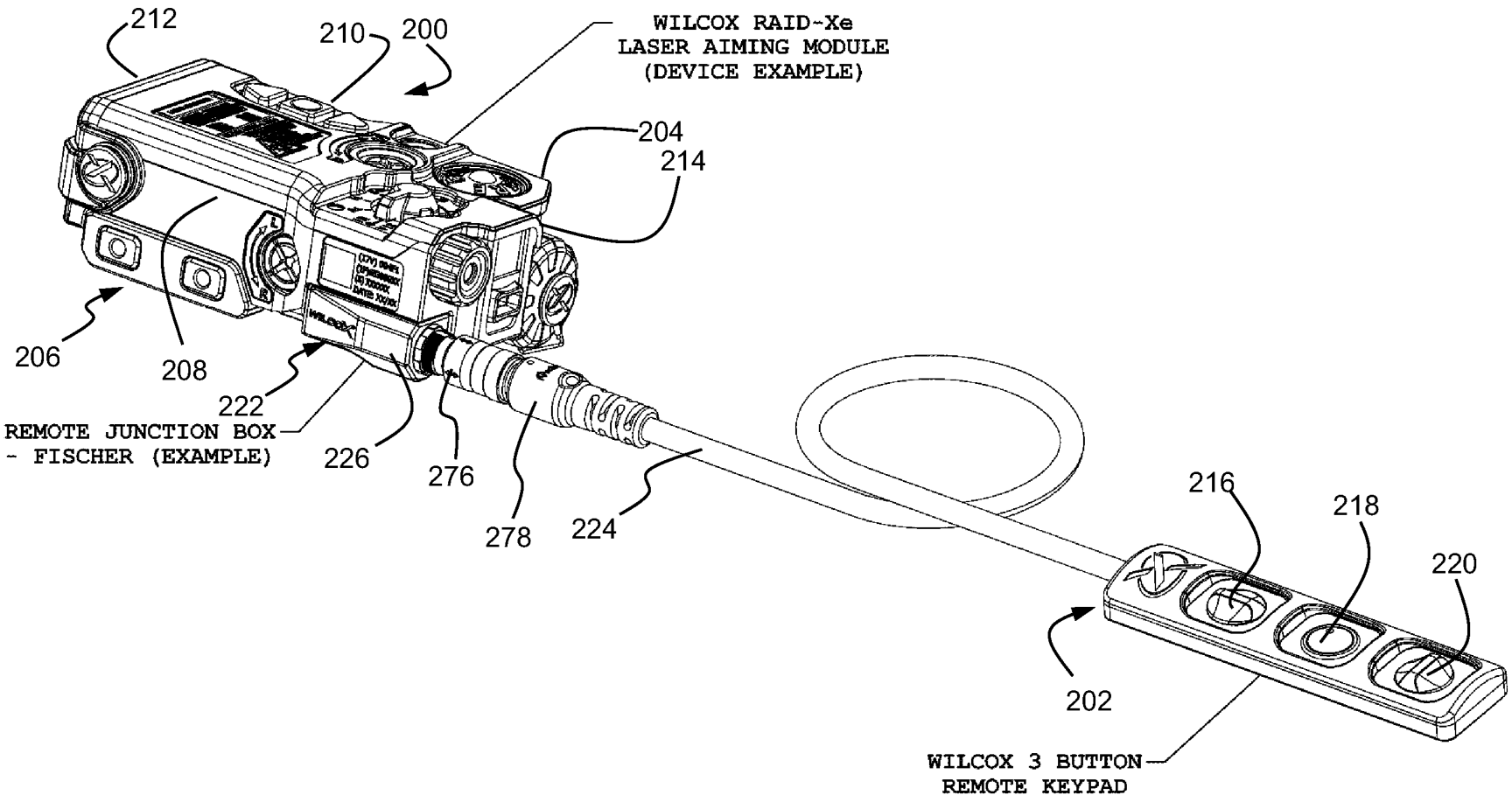
FIG. 2A is an isometric view of a weapon accessory device having a remote control junction box interface in accordance with a second exemplary embodiment.

With respect to the figures, like reference numerals are used to describe like or analogous items in which the hundreds digit has been increased to correspond to the figure number (e.g., the remote control unit 102 in FIG. 1A corresponds to the remote control unit 202 in FIG. 2A, and so forth). The description in reference to any given reference numeral herein is equally applicable to other reference numerals that differ only in the hundreds digit, unless specifically stated otherwise.

Figure 1B:
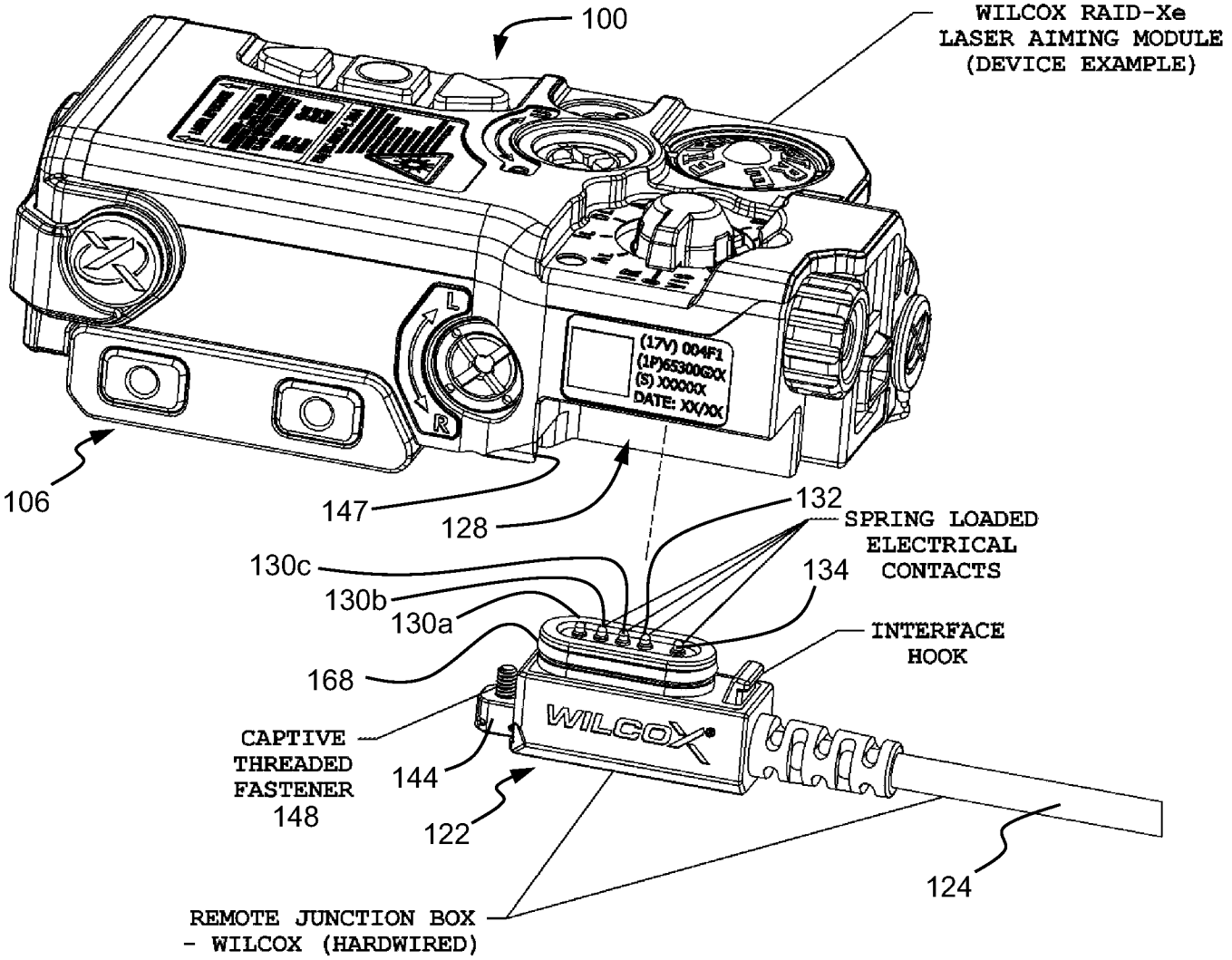
FIG. 1B is an enlarged, fragmentary, isometric, assembly view of the weapon accessory device having a remote control junction box interface appearing in FIG. 1A.

Referring now to FIGS. 1A and 1B, there appears an exemplary weapon accessory device 100 operatively coupled to a remote control unit 102. For illustration purposes, the accessory device 100 is a laser aiming and illuminating device and may include functionality which is the same as or based upon the WILCOX® RAID Xe™ laser aiming device (Wilcox Industries Corp. of Newington, NH). It will be recognized that the present development is applicable to other weapon accessory devices that are remote control capable, including range finders, ballistics computation devices, sighting systems, fire control systems, and others.

The accessory device 100 includes a housing 104 defining an enclosure or shell containing the internal components of the accessory device 100. A rail clamp assembly 106 is provided for releasably attaching the unit 100 to an accessory mounting rail of a weapon (not shown), such as Picatinny rail (e.g., MIL-STD-1913 accessory rails, STANAG 2324 accessory rails, or the like), which are well understood by persons skilled in the art.

The accessory device 100 generally defines a footprint having a lateral extent defined by the left and right sides 108, 110, respectively, of the unit 100 and an axial extent defined by the front and rear sides 112, 114, respectively, of the unit 100.

The remote control unit 102 includes one or more manually actuatable elements, such as one or more keys or switches 116, 118, 120. A junction box 122 is electrically coupled to the remote control unit 102 via an electrical cable 124. The junction box 122 includes a housing 126 attachable to the housing 104. In embodiments, the housing 126 is removably attachable to the housing 104. In embodiments, the housing 104 includes a recess or notch 128 which is sized to accommodate the junction box housing 126 such that the junction box housing is disposed within the footprint defined by the accessory housing 104.

In the illustrated embodiment, the cable 124 is a multi-circuit or multi-conductor cable which electrically couples each of the switches 116, 118, 120, with a respective one of electrical contact pins 130*a*, 130*b*, and 130*c*. A ground pin 132 is common to each of the switches 116, 118, and 120. A shield contact pin 134 is in electrical communication with a shielding conductor in the cable 124, such as a braided, mesh, foil, tape, or conductive polymer shield, or the like. In embodiments, the contact pins 130*a*, 130*b*, 130*c*, 132, 134, are telescoping, spring biased pins (i.e., pogo pins), conductive spring-loaded buttons, or other suitable physical connection feature.

Figure 1C:
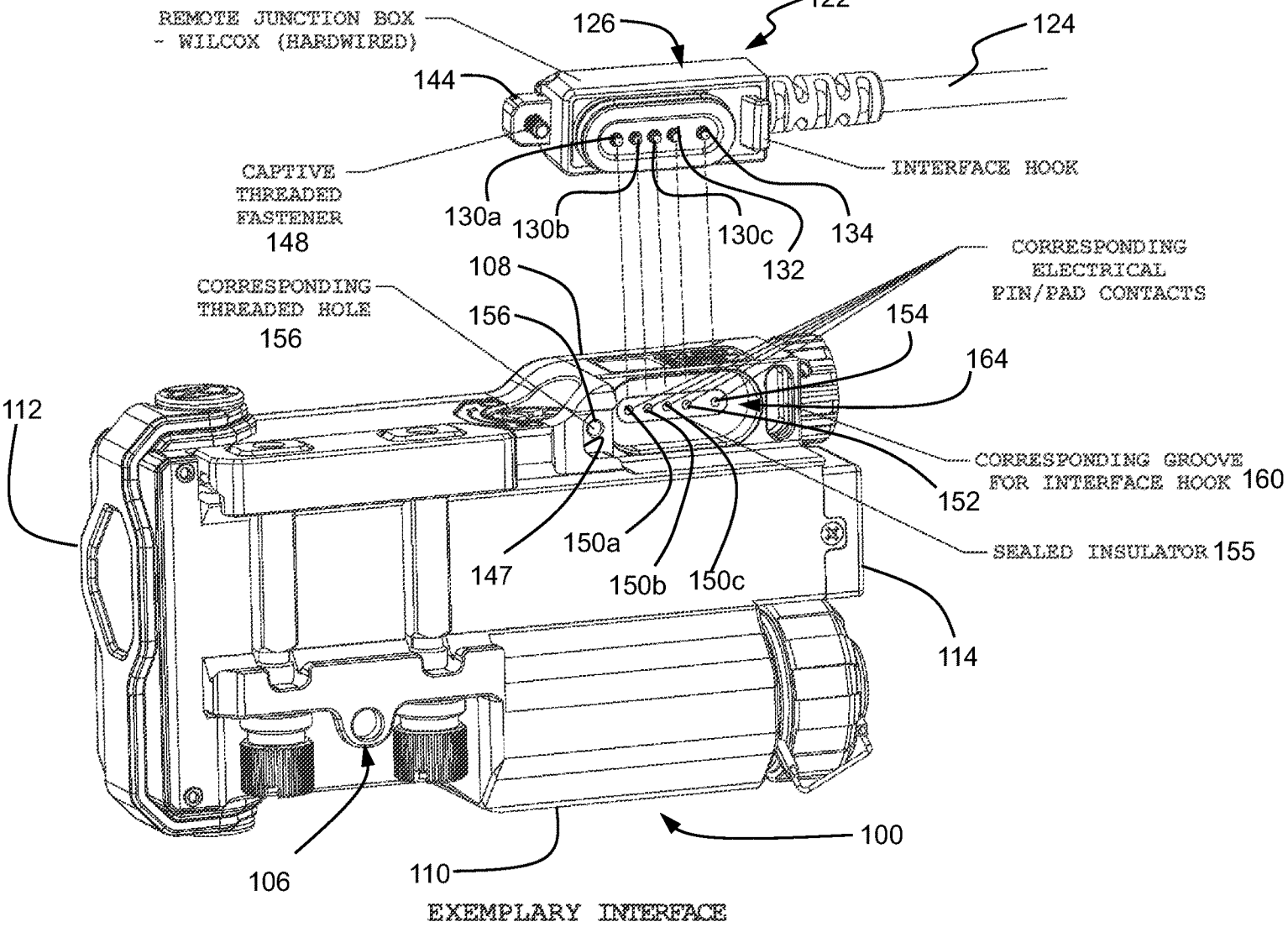
FIG. 1C is an enlarged, fragmentary, isometric, assembly view of the weapon accessory device having a remote control junction box interface appearing in FIG. 1.
Figure 1D:
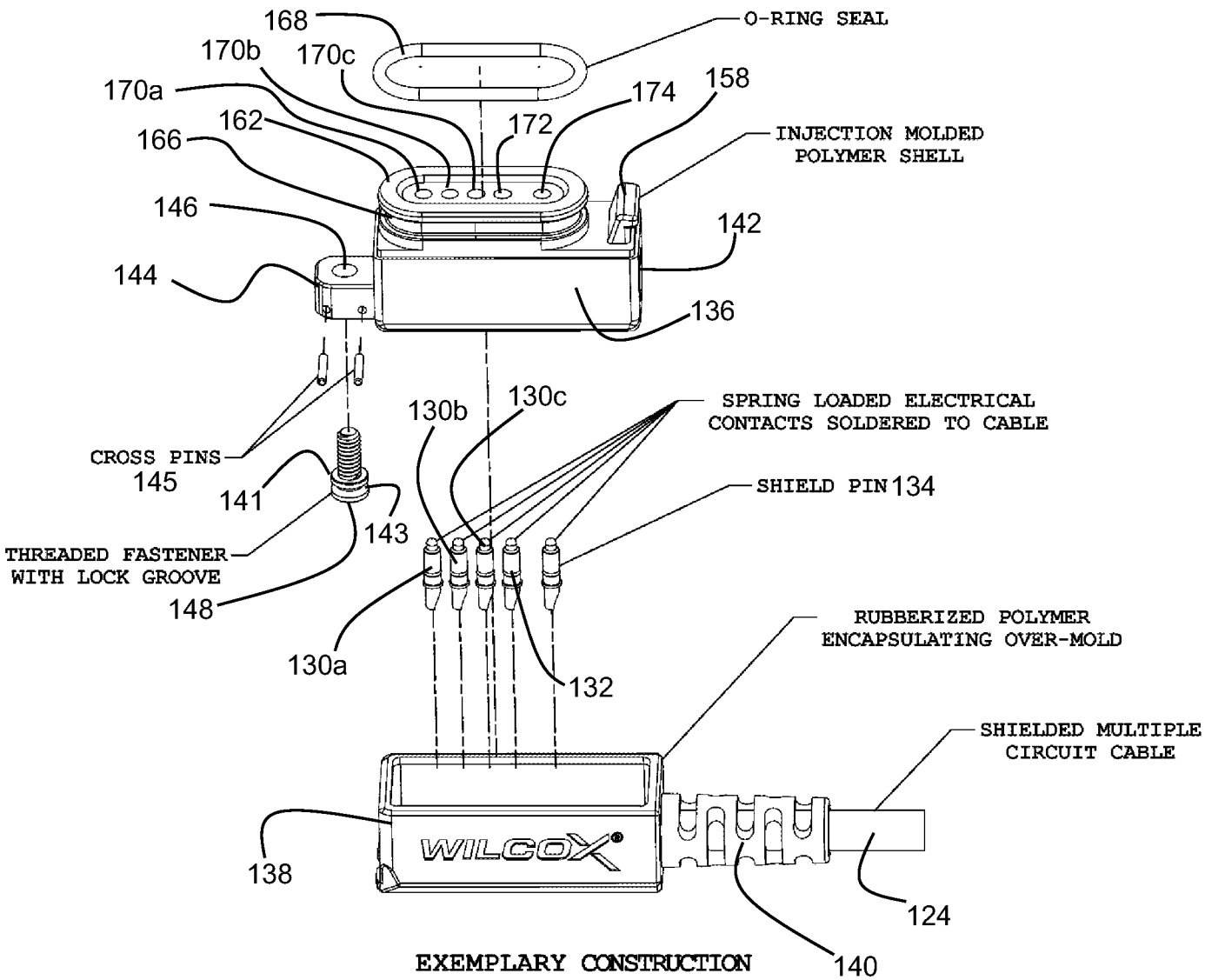
FIG. 1D is an enlarged, isometric, exploded view of the junction box appearing in FIG. 1.

With reference now to FIGS. 1C and 1D, there appears a first embodiment junction box 122 wherein the housing 126 includes an inner housing shell 136, which may be molded, e.g., injection molded, of a polymer material. The inner housing shell 136 is encased within an overmolded jacket 138. The term "overmolded" means that jacket 138 at least partly extends over or around or engulfs one or more parts of the inner housing shell 136 to create a unitary structure. In the embodiment appearing in FIG. 1C, the jacket 138 includes a strain relief member 140 configured to provide strain relief to the electrical conductors within the cable 124. The strain relief member 140 is aligned with an opening 142 in the inner housing shell 136 and the cable 124 passes through the strain relief member 140 and opening 142 into the interior of the shell 136.

Each of the conductor elements in the cable 124 are in electrical communication with a respective one of the electrical contact pins 130*a*, 130*b*, 130*c*, 132, and 134. Each of the electrical contact pins 130*a*, 130*b*, 130*c*, 132, and 134, in turn, contact a respective electrical contact pad 150*a*, 150*b*, 150*c*, 152, and 154 on the accessory device 100 within the receptacle 128. The electrical contact pad 150*a*, 150*b*, 150*c*, 152, and 154 are disposed within a sealed insulator 155 configured to resist entry of moisture or environmental contamination. The electrical contact pad 150*a*, 150*b*, 150*c*, 152, and 154, in turn, are in electrical communication with the electrical and/or electronic components of the accessory device 100.

The junction box shell 136 includes a tab 144 having a through bore 146 receiving a captive rotatable threaded fastener 148 for securing the junction box 122 to the accessory device 100. In the illustrated embodiment, the fastener 148 includes a head 141 having a lock groove 143. Cross pins 145 engage the lock groove 143 to prevent removal of the threaded fastener 148 from the opening 146. The tab 144 is received within a complementary recess 147 in the accessory device 100.

The threaded fastener 148 is aligned with a threaded opening 156 on the accessory device 100. The junction box shell 136 further includes an interface hook 158 engaging a complementary receptacle 160 in the accessory device 100 to provide an additional point of attachment.

The junction box shell 136 further includes an upstanding boss 162 having a plurality of openings 170*a*, 170*b*, 170*c*, 172, and 174 receiving the respective pins 130*a*, 130*b*, 130*c*, 132, and 134. The boss 162 is received within a complementary receptacle 164 on the accessory device 100. An annular channel 166 is formed on the boss 162. An or gasket 168 is received within the channel 166 and is configured to provide a sealing interference between the boss 162 and the receptacle 164.

Figure 2B:
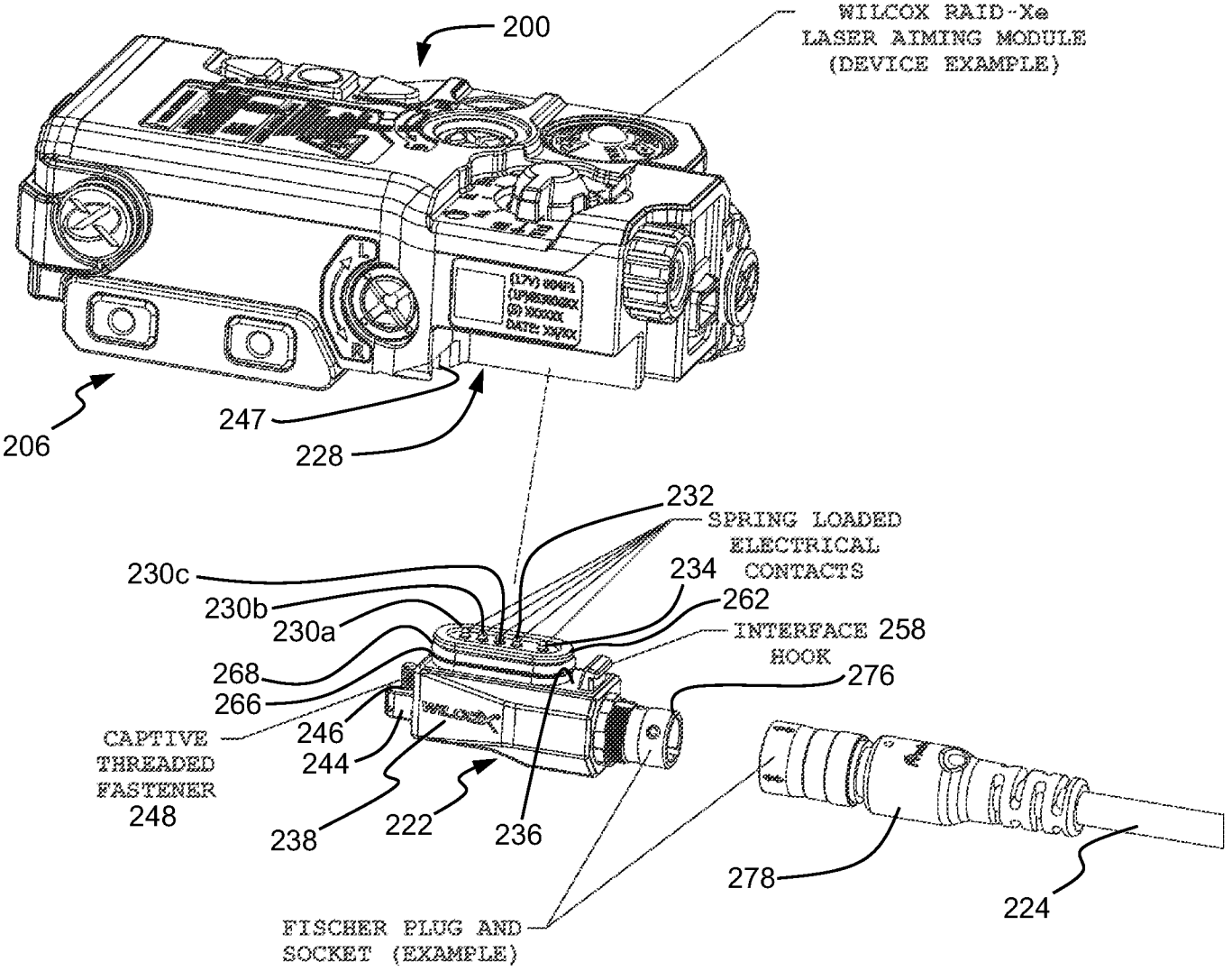
FIG. 2B is an enlarged, fragmentary, isometric, assembly view of the weapon accessory device having a remote control junction box interface appearing in FIG. 2A.

Referring now to FIGS. 2A and 2B, there appears a second embodiment weapon accessory device 200 operatively coupled to a remote control unit 202. The accessory device 200 includes a housing 204 defining an enclosure or shell containing the internal components of the accessory device 200. A rail clamp assembly 206 is provided for releasably attaching the unit 200 to an accessory mounting rail of a weapon (not shown), such as Picatinny rail (e.g., MIL-STD-1913 accessory rails, STANAG 2324 accessory rails, or the like), which are well understood by persons skilled in the art.

The accessory device 200 generally defines a footprint having a lateral extent defined by the left and right sides 208, 210, respectively, of the unit 200 and an axial extent defined by the front and rear sides 212, 214, respectively, of the unit 200.

The remote control unit 202 includes one or more manually actuatable elements, such as one or more keys or switches 216, 218, 220. A junction box 222 is electrically coupled to the remote control unit 202 via an electrical cable 224. The junction box 222 includes a housing 226 attachable to the housing 204. In embodiments, the housing 226 is removably attachable to the housing 204. In embodiments, the housing 204 includes a recess or notch 228 which is sized to accommodate the junction box housing 226 such that the junction box housing is disposed within the footprint defined by the accessory housing 204.

In the illustrated embodiment, the cable 224 is a multi-circuit or multi-conductor cable which electrically couples each of the switches 216, 218, 220 with a respective one of electrical contact pins 230*a*, 230*b*, and 230*c*. A ground pin 232 is common to each of the switches 216, 218, and 220. A shield contact pin 234 is in electrical communication with a shielding conductor in the cable 224, such as a braided, mesh, foil, tape, or conductive polymer shield, or the like. In embodiments, the contact pins 230*a*, 230*b*, 230*c*, 232, 234, are telescoping, spring biased pins (i.e., pogo pins), conductive spring-loaded buttons, or other suitable physical connection feature. In embodiments, the housing 226 includes an inner housing shell 236, which may be molded, e.g., injection molded, of a polymer material. The inner housing shell 236 is encased within an overmolded jacket 238.

Each of the conductor elements in the cable 224 are in electrical communication with a respective one of the electrical contact pins 230*a*, 230*b*, 230*c*, 232, and 234. Each of the electrical contact pins 230*a*, 230*b*, 230*c*, 232, and 234, in turn, contact a respective electrical contact pad on the accessory device 200 within the receptacle 228. The electrical contact pads are disposed within a sealed insulator on the device 200 as detailed above which is configured to resist entry of moisture or environmental contamination. The electrical contact pads, in turn, are in electrical communication with the electrical and/or electronic components of the accessory device 200.

The junction box shell 236 includes a tab 244 having a through bore 246 receiving a captive rotatable threaded fastener 248 for securing the junction box 222 to the accessory device 200 as detailed above. The tab 244 is received within a complementary recess 247 in the accessory device 200. The threaded fastener 248 is aligned with a threaded opening on the accessory device 200. The junction box shell 236 further includes an interface hook 258 engaging a complementary receptacle in the accessory device 200 to provide an additional point of attachment, as described above.

The junction box shell 236 further includes an upstanding boss 262 having a plurality of openings receiving the pins 230*a*, 230*b*, 230*c*, 232, and 234. The boss 262 is received within a complementary receptacle on the accessory device 200, as described above. An annular channel 266 is formed on the boss 262. An O-ring or gasket 268 is received within the channel 266 and is configured to provide a sealing interference between the boss 262 and the corresponding receptacle on the device 200.

The pins 230*a*, 230*b*, 230*c*, 232, and 234 are electrically coupled to a first electrical connector 276. In embodiments, the first electrical connector 276 is a male electrical connector or plug. The electrical conductors in the cable 224 are electrically coupled to a second electrical connector 278. In embodiments, the second electrical connector 278 is a female electrical connector or socket. In embodiments, the first and second connectors are commercially available connectors from Fischer Connectors SA of Saint-Prex, Switzerland.

Figure 3A:
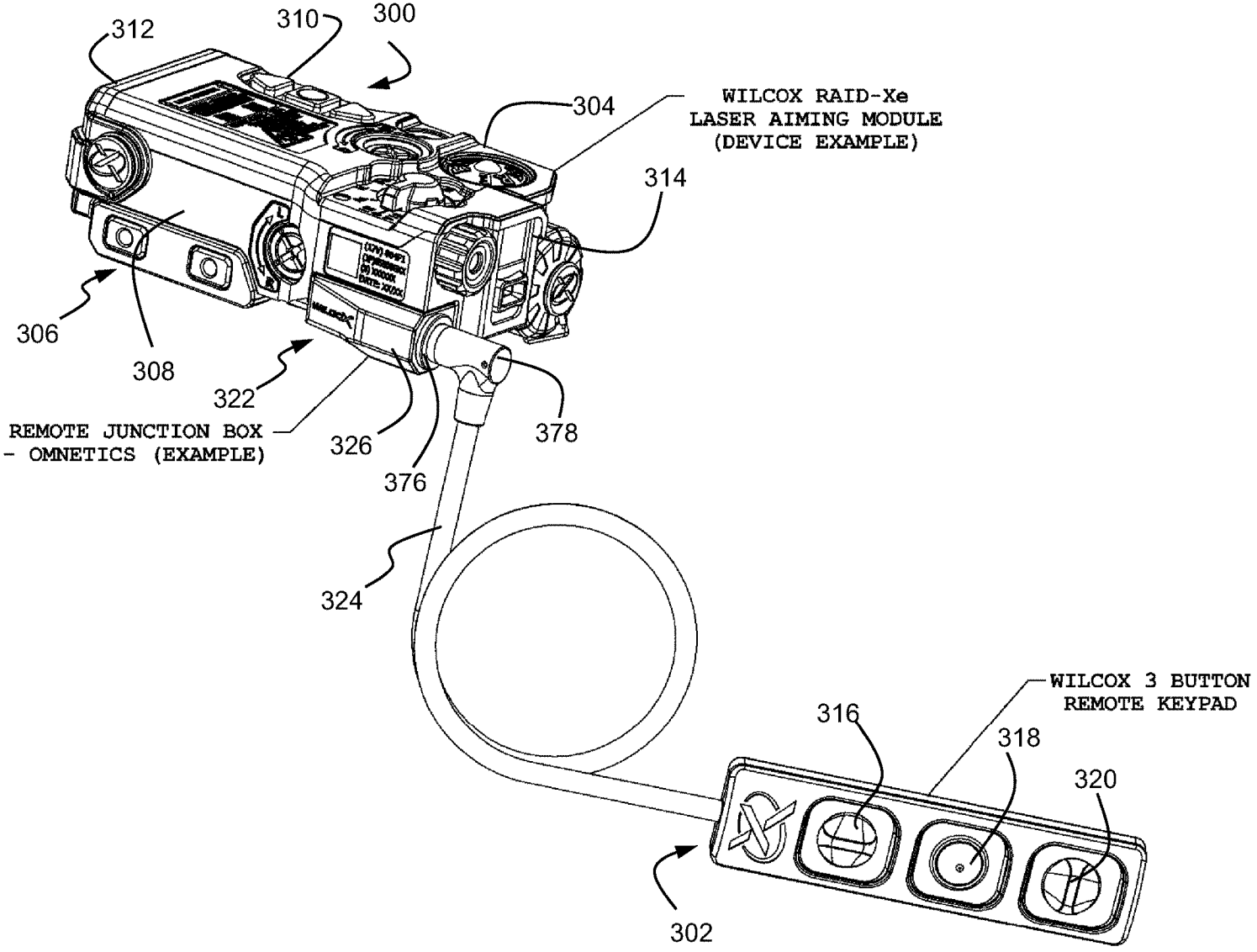
FIG. 3A is an isometric view of a weapon accessory device having a remote control junction box interface in accordance with a third exemplary embodiment.
Figure 3B:
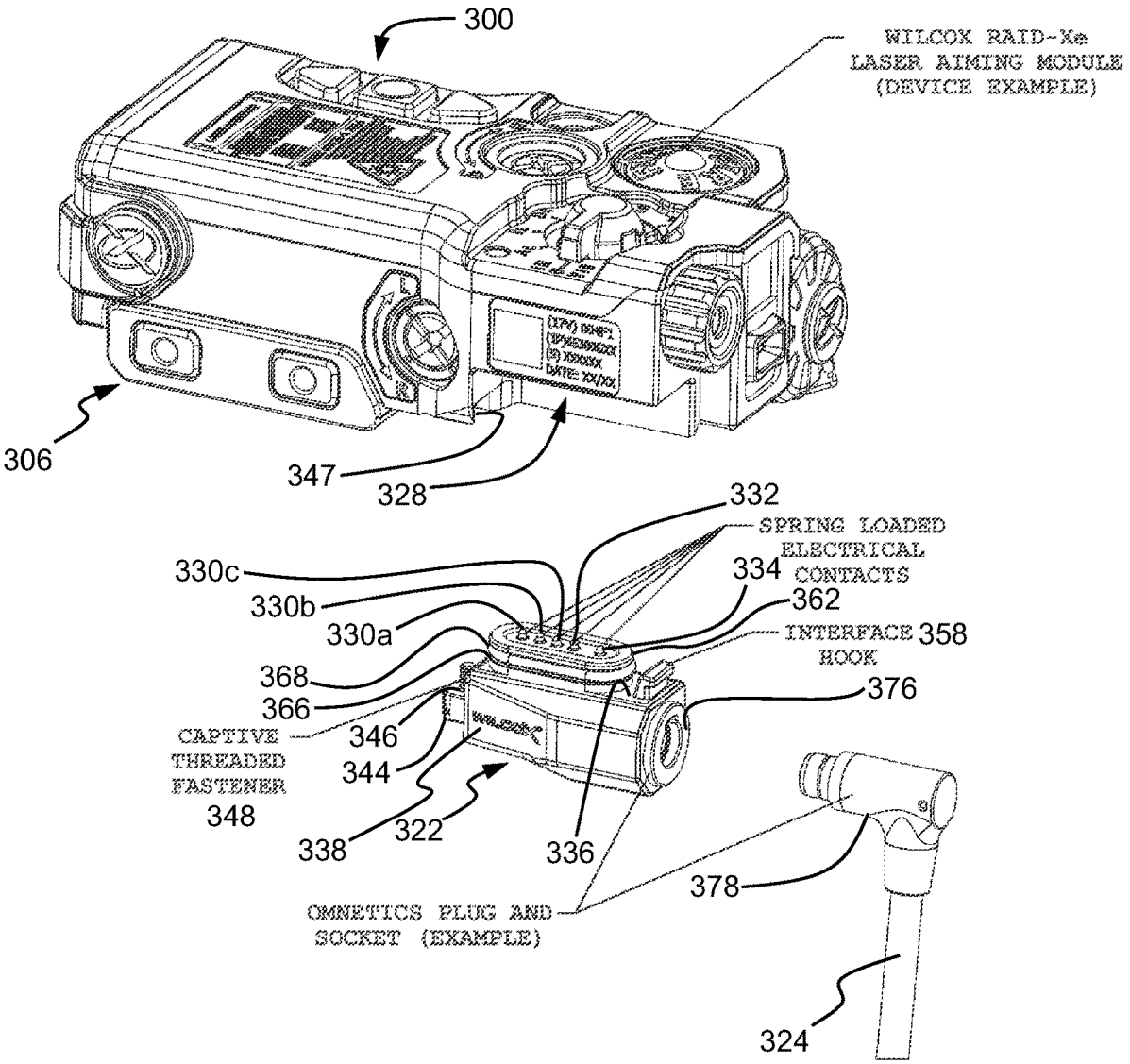
FIG. 3B is an enlarged, fragmentary, isometric, assembly view of the weapon accessory device having a remote control junction box interface appearing in FIG. 3A.

Referring now to FIGS. 3A and 3B, there appears a third embodiment weapon accessory device 300 operatively coupled to a remote control unit 302. The accessory device 300 includes a housing 304 defining an enclosure or shell containing the internal components of the accessory device 300. A rail clamp assembly 306 is provided for releasably attaching the unit 300 to an accessory mounting rail of a weapon (not shown), such as Picatinny rail (e.g., MIL-STD-1913 accessory rails, STANAG 2324 accessory rails, or the like), which are well understood by persons skilled in the art.

The accessory device 300 generally defines a footprint having a lateral extent defined by the left and right sides 308, 310, respectively, of the unit 300 and an axial extent defined by the front and rear sides 312, 314, respectively, of the unit 300.

The remote control unit 302 includes one or more manually actuatable elements, such as one or more keys or switches 316, 318, 320. A junction box 322 is electrically coupled to the remote control unit 302 via an electrical cable 324. The junction box 322 includes a housing 326 attachable to the housing 304. In embodiments, the housing 326 is removably attachable to the housing 304. In embodiments, the housing 304 includes a recess or notch 328 which is sized to accommodate the junction box housing 326 such that the junction box housing is disposed within the footprint defined by the accessory housing 304.

In the illustrated embodiment, the cable 324 is a multi-circuit or multi-conductor cable which electrically couples each of the switches 316, 318, 320 with a respective one of electrical contact pins 330*a*, 330*b*, and 330*c*. A ground pin 332 is common to each of the switches 316, 318, and 320. A shield contact pin 334 is in electrical communication with a shielding conductor in the cable 324, such as a braided, mesh, foil, tape, or conductive polymer shield, or the like. In embodiments, the contact pins 330*a*, 330*b*, 330*c*, 332, 334, are telescoping, spring biased pins (i.e., pogo pins), conductive spring-loaded buttons, or other suitable physical connection feature. In embodiments, the housing 326 includes an inner housing shell 336, which may be molded, e.g., injection molded, of a polymer material. The inner housing shell 336 is encased within an overmolded jacket 338.

Each of the conductor elements in the cable 324 are in electrical communication with a respective one of the electrical contact pins 330*a*, 330*b*, 330*c*, 332, and 334. Each of the electrical contact pins 330*a*, 330*b*, 330*c*, 332, and 334, in turn, contact a respective electrical contact pad on the accessory device 300 within the receptacle 328. The electrical contact pads are disposed within a sealed insulator on the device 300 as detailed above which is configured to resist entry of moisture or environmental contamination. The electrical contact pads, in turn, are in electrical communication with the electrical and/or electronic components of the accessory device 300.

The junction box shell 336 includes a tab 344 having a through bore 346 receiving a captive rotatable threaded fastener 348 for securing the junction box 322 to the accessory device 300 as detailed above. The tab 344 is received within a complementary recess 347 in the accessory device 1300. The threaded fastener 348 is aligned with a threaded opening on the accessory device 300. The junction box shell 336 further includes an interface hook 358 engaging a complementary receptacle in the accessory device 300 to provide an additional point of attachment, as described above.

The junction box shell 336 further includes an upstanding boss 362 having a plurality of openings receiving the pins 330*a*, 330*b*, 330*c*, 332, and 334. The boss 362 is received within a complementary receptacle on the accessory device 300, as described above. An annular channel 366 is formed on the boss 362. An O-ring or gasket 368 is received within the channel 366 and is configured to provide a sealing interference between the boss 362 and the corresponding receptacle on the device 300.

The pins 330*a*, 330*b*, 330*c*, 332, and 334 are electrically coupled to a first electrical connector 376. In embodiments, the first electrical connector 376 is a female electrical connector or socket. The electrical conductors in the cable 324 are electrically coupled to a second electrical connector 378. In embodiments, the second electrical connector 378 is a male electrical connector or plug. In embodiments, the first and second connectors are commercially available connectors from Omnetics Connector Corporation of Minneapolis, Minnesota.

Figure 4A:
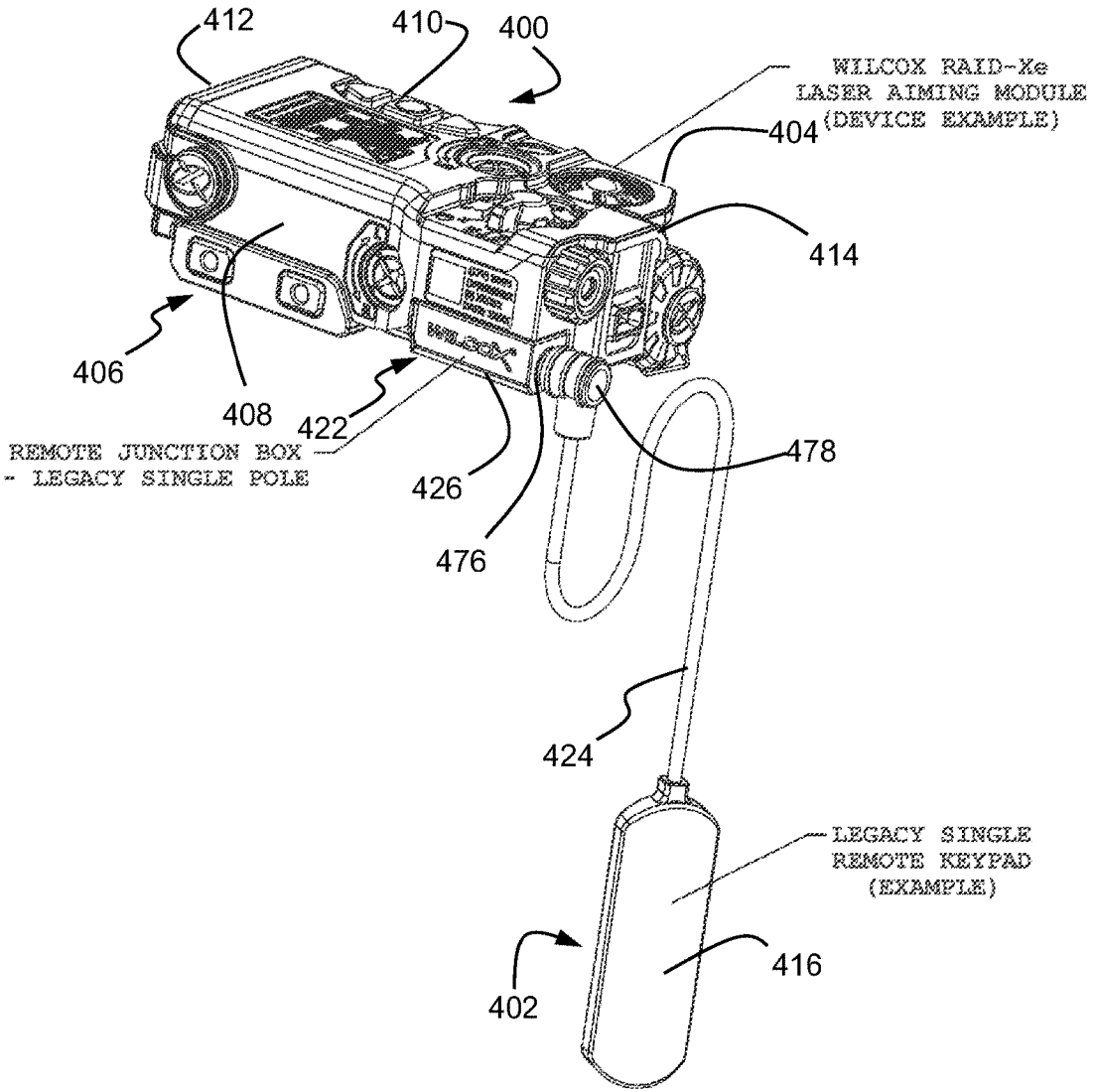
FIG. 4A is an isometric view of a weapon accessory device having a remote control junction box interface in accordance with a fourth exemplary embodiment.
Figure 4B:
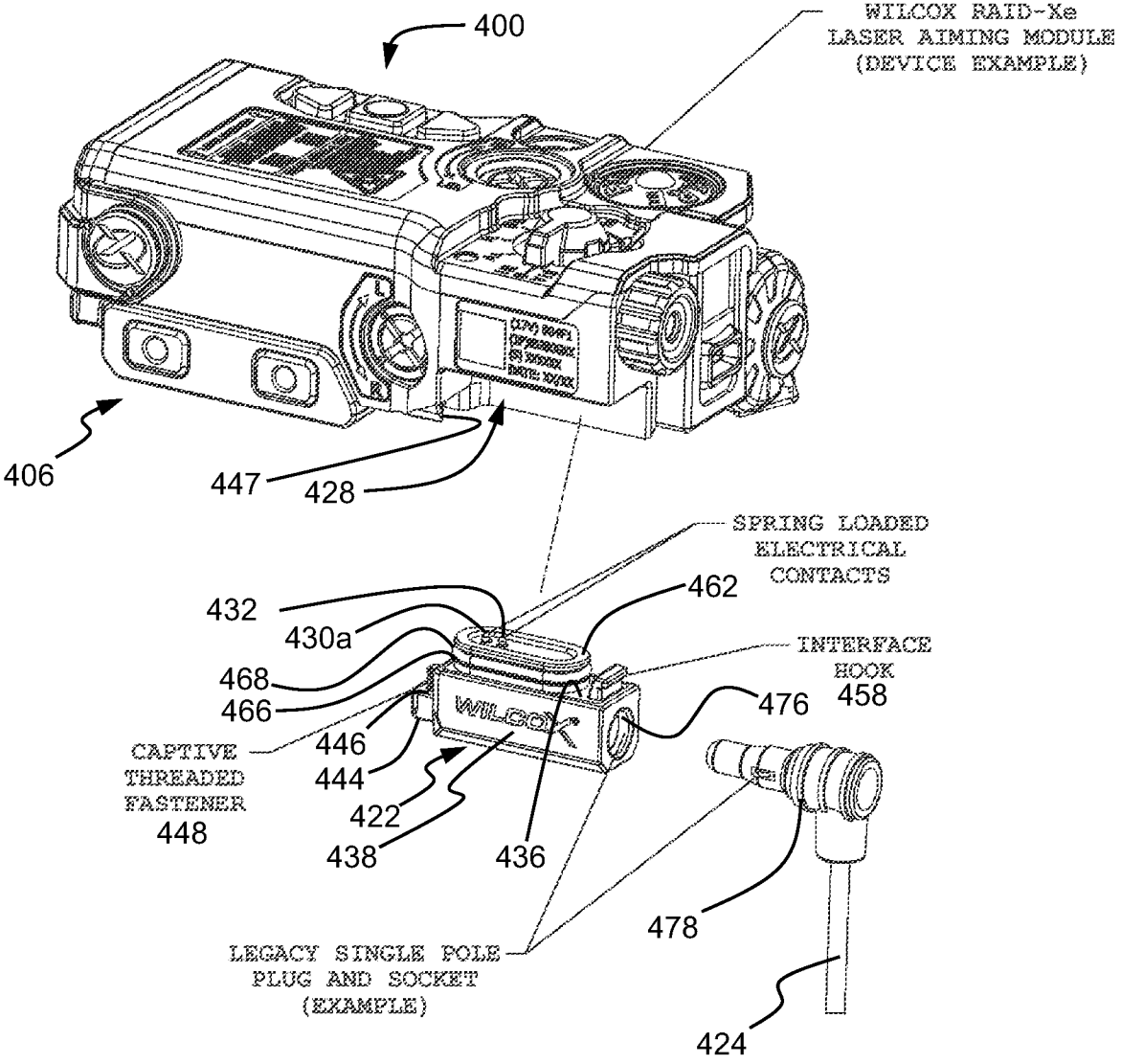
FIG. 4B is an enlarged, fragmentary, isometric, assembly view of the weapon accessory device having a remote control junction box interface appearing in FIG. 4A.

Referring now to FIGS. 4A and 4B, there appears a fourth embodiment weapon accessory device 400 operatively coupled to a remote control unit 402. The accessory device 400 includes a housing 404 defining an enclosure or shell containing the internal components of the accessory device 400. A rail clamp assembly 406 is provided for releasably attaching the unit 400 to an accessory mounting rail of a weapon (not shown), such as Picatinny rail (e.g., MIL-STD-1913 accessory rails, STANAG 2324 accessory rails, or the like), which are well understood by persons skilled in the art.

The accessory device 400 generally defines a footprint having a lateral extent defined by the left and right sides 408, 410, respectively, of the unit 400 and an axial extent defined by the front and rear sides 412, 414, respectively, of the unit 400.

The remote control unit 402 includes one or more manually actuatable elements, such as a key, switch, or pressure pad sensor 416. A junction box 422 is electrically coupled to the remote control unit 402 via an electrical cable 424. The junction box 422 includes a housing 426 attachable to the housing 404. In embodiments, the housing 426 is removably attachable to the housing 404. In embodiments, the housing 404 includes a recess or notch 428 which is sized to accommodate the junction box housing 426 such that the junction box housing is disposed within the footprint defined by the accessory housing 404.

In the illustrated embodiment, the cable 424 electrically couples the switch 416 with an electrical contact pin 430*a* and a ground pin 432. In embodiments, the contact pins 430*a* and 432 are telescoping, spring biased pins (i.e., pogo pins), conductive spring-loaded buttons, or other suitable physical connection feature. In embodiments, the housing 426 includes an inner housing shell 436, which may be molded, e.g., injection molded, of a polymer material. The inner housing shell 436 is encased within an overmolded jacket 438.

Each of the conductor elements in the cable 424 are in electrical communication with a respective one of the electrical contact pins 430*a*, 432. Each of the electrical contact pins 430*a*, 432, in turn, contact a respective electrical contact pad on the accessory device 400 within the receptacle 428. The electrical contact pads are disposed within a sealed insulator on the device 400 as detailed above which is configured to resist entry of moisture or environmental contamination. The electrical contact pads, in turn, are in electrical communication with the electrical and/or electronic components of the accessory device 400.

The junction box shell 436 includes a tab 444 having a through bore 446 receiving a captive rotatable threaded fastener 448 for securing the junction box 422 to the accessory device 400 as detailed above. The tab 444 is received within a complementary recess 447 in the accessory device 400. The threaded fastener 448 is aligned with a threaded opening on the accessory device 400. The junction box shell 436 further includes an interface hook 458 engaging a complementary receptacle in the accessory device 400 to provide an additional point of attachment, as described above.

The junction box shell 436 further includes an upstanding boss 462 having a plurality of openings receiving the pins 430*a*, 432. The boss 462 is received within a complementary receptacle on the accessory device 400, as described above. An annular channel 466 is formed on the boss 462. An O-ring or gasket 468 is received within the channel 466 and is configured to provide a sealing interference between the boss 462 and the corresponding receptacle on the device 400.

The pins 430*a*, 432, are electrically coupled to a first electrical connector 476. In embodiments, the first electrical connector 476 is a female electrical connector or socket. The electrical conductors in the cable 424 are electrically coupled to a second electrical connector 478. In embodiments, the second electrical connector 478 is a male electrical connector or plug. In embodiments, the first electrical connector 476 is a remote control activation pad port compatible with legacy remote control units from Wilcox Industries Corp. of Newington, New Hampshire. The second connector 478 is a Wilcox Industries Corp. legacy remote control activation pad connector.

Figure 5:
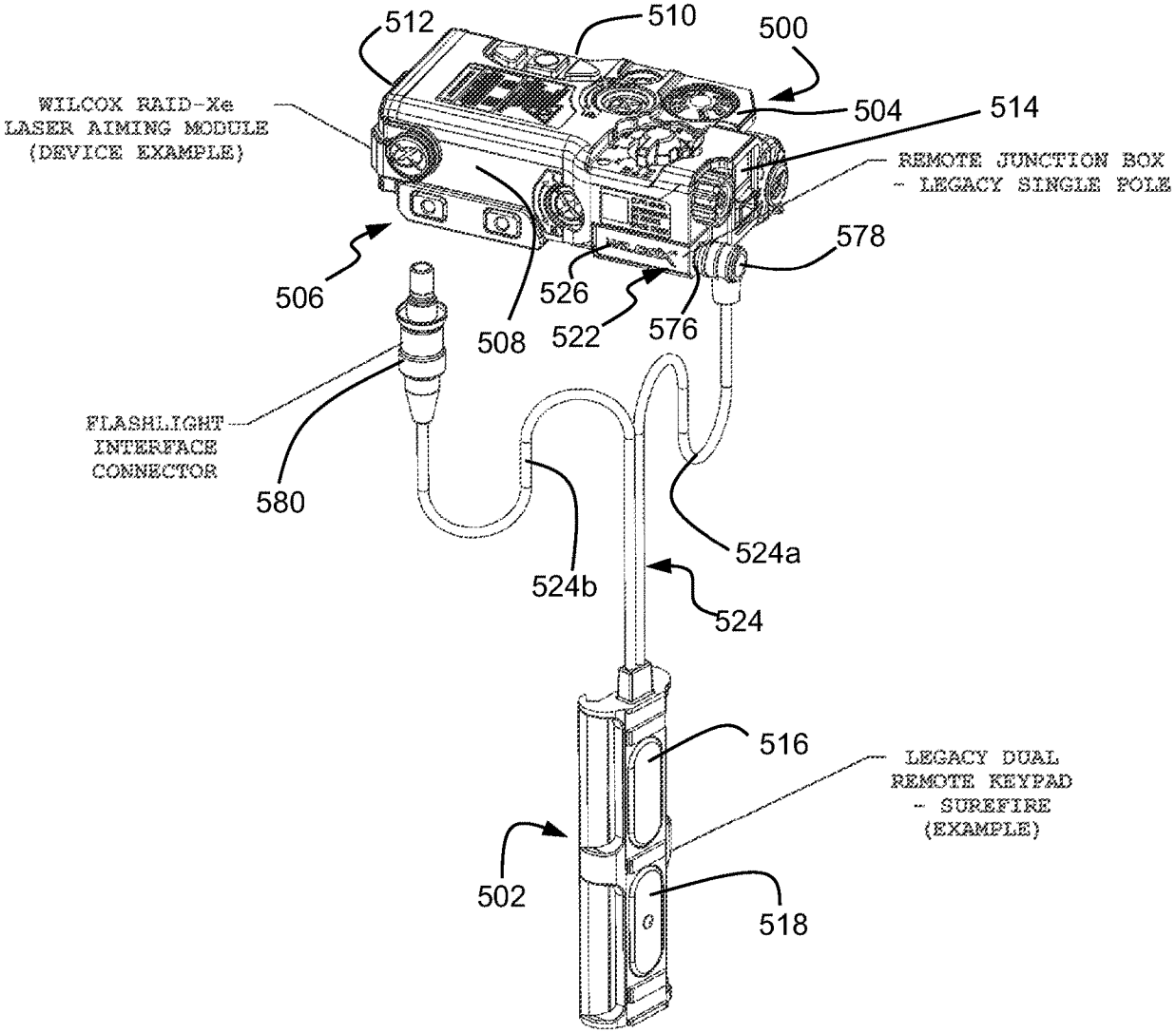
FIG. 5 is an isometric view of a weapon accessory device having a remote control junction box interface in accordance with a fifth exemplary embodiment.

Referring now to FIG. 5, there appears a fifth embodiment weapon accessory device 500 operatively coupled to a remote control unit 502. The accessory device 500 includes a housing 504 defining an enclosure or shell containing the internal components of the accessory device 500. A rail clamp assembly 506 is provided for releasably attaching the unit 500 to an accessory mounting rail of a weapon (not shown), such as Picatinny rail (e.g., MIL-STD-1913 accessory rails, STANAG 2324 accessory rails, or the like), which are well understood by persons skilled in the art.

The accessory device 500 generally defines a footprint having a lateral extent defined by the left and right sides 508, 510, respectively, of the unit 500 and an axial extent defined by the front and rear sides 512, 514, respectively, of the unit 500.

The remote control unit 502 includes one or more manually actuatable elements, such as a key, switch, or pressure pad sensors 516, 518. A junction box 522 is electrically coupled to the remote control unit 502 via an electrical cable 524, comprising a first cable 524*a* and a second cable 524*b*. The junction box 522 includes a housing 526 attachable to the housing 504. In embodiments, the housing 526 is removably attachable to the housing 104. In embodiments, the housing 504 includes a recess or notch as detailed above which is sized to accommodate the junction box housing 526 such that the junction box housing is disposed within the footprint defined by the accessory housing 504.

In the illustrated embodiment, the cable 524*a* electrically couples the switch 516 with electrical contact and ground pins as described above. In embodiments, the contact pins are telescoping, spring biased pins (i.e., pogo pins), conductive spring-loaded buttons, or other suitable physical connection feature. In embodiments, the housing 526 includes an inner housing shell as detailed above, which may be molded, e.g., injection molded, of a polymer material and encased within an overmolded jacket as described above.

Each of the conductor elements in the cable 524*a* are in electrical communication with a respective one of the electrical contact pins which, in turn, contact a respective electrical contact pad on the accessory device 500 within the junction box receiving receptacle. The electrical contact pads are disposed within a sealed insulator on the device 500 as detailed above which is configured to resist entry of moisture or environmental contamination. The electrical contact pads, in turn, are in electrical communication with the electrical and/or electronic components of the accessory device 500. The construction and manner of attachment of the junction box 522 may be as described above.

The electrical contact pins on the junction box 522 are electrically coupled to a first electrical connector 576. In embodiments, the first electrical connector 576 is a female electrical connector or socket. The electrical conductors in the cable 524*a* are electrically coupled to a second electrical connector 578. In embodiments, the second electrical connector 578 is a male electrical connector or plug. In embodiments, the first electrical connector 576 is a remote control activation pad port compatible with legacy remote control units from Wilcox Industries Corp. of Newington, New Hampshire and the second connector 578 is a Wilcox Industries Corp. legacy remote control activation pad connector.

In the illustrated embodiment, the cable 524*b* electrically couples the switch 518 to a third electrical connector 580 to allow the remote control unit 502 to control a second accessory device (not shown), such as a flashlight or weapon light. In the illustrated embodiment, the third electrical connector 580 weapon light plug connector compatible with weapon lights having a compatible remote control switch socket from SureFire, LLC of Fountain Valley, CA.

Figure 6:
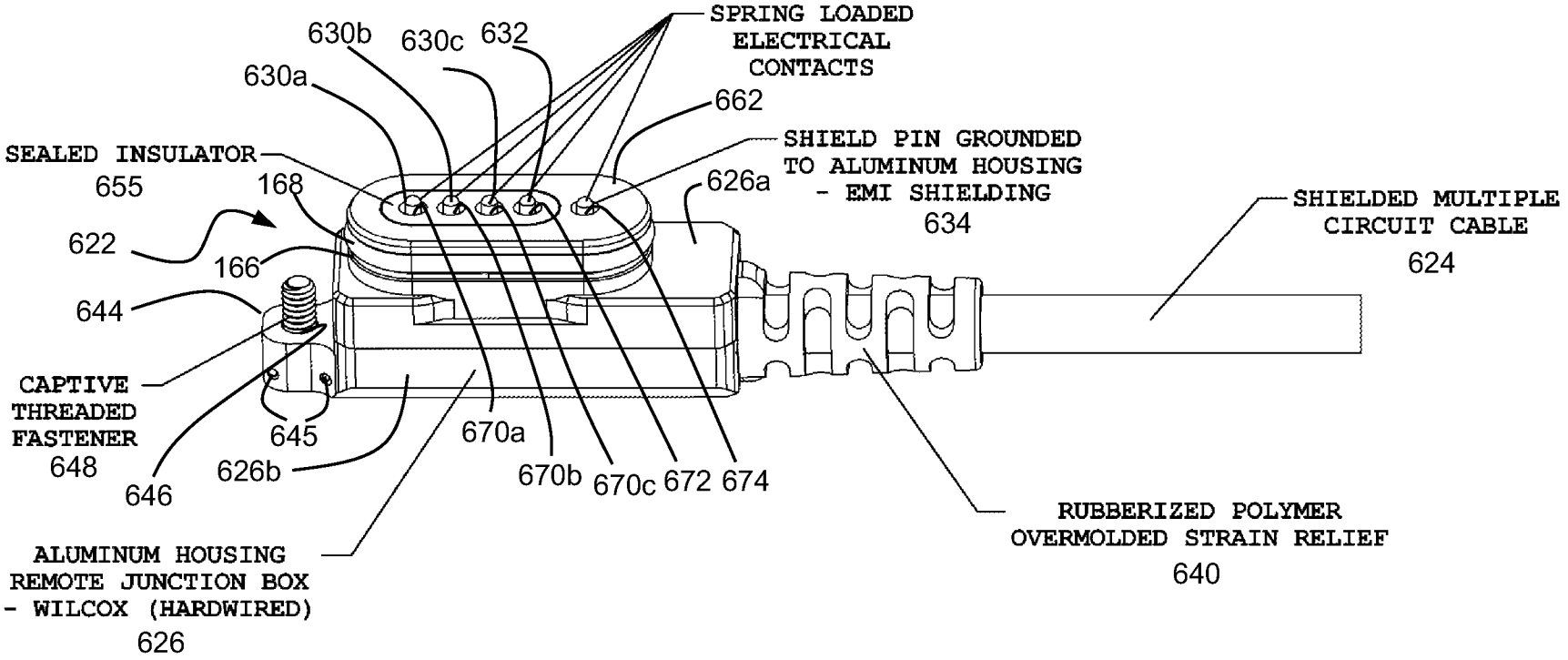
FIG. 6 is an enlarged, isometric, exploded view of and alternative junction box.

With reference now to FIG. 6, there appears an alternative embodiment junction box 622 wherein the housing 626 is formed of a metal such as aluminum to provide shielding against electromagnetic interference. In embodiments, the housing 626 is formed of an upper shell 626*a* and a lower shell 626*b*. An overmolded strain relief member 640 is configured to provide strain relief to the electrical conductors within the cable 624. The strain relief member 640 is aligned with an opening in the housing shell 626 and the cable 624 passes through the strain relief member 640 and the opening into the interior of the housing 626.

Each of the conductor elements in the cable 624 are in electrical communication with a respective one of the electrical contact pins 630*a*, 630*b*, 630*c*, 632, and 634. Each of the electrical contact pins 630*a*, 630*b*, 630*c*, 632, and 634, in turn, contact a respective electrical contact pad a connected accessory device as detailed above. The electrical contact pads are disposed within a sealed insulator configured to resist entry of moisture or environmental contamination as described above. The electrical contact pads on the accessory device as, in turn, are in electrical communication with the electrical and/or electronic components of the associated accessory device.

The junction box 626 includes a tab 644 having a through bore 646 receiving a captive rotatable threaded fastener 648 for securing the junction box 622 to the accessory device. In the illustrated embodiment, the fastener 648 includes a head having a lock groove as described above. Cross pins 645 engage the lock groove 643 to prevent removal of the threaded fastener 648 from the opening 646. The threaded fastener 648 is aligned with a threaded opening 656 on the accessory device as described above. The junction box 626 further includes an upstanding boss 662 having a plurality of openings 670*a*, 670*b*, 670*c*, 672, and 674 receiving the respective pins 630*a*, 630*b*, 630*c*, 632, and 634, which protrude therethrough. The boss 662 is received within a complementary receptacle on the accessory device, as discussed above. An annular channel 666 is formed on the boss 662. An O-ring or gasket 668 is received within the channel 666 and is configured to provide a sealing interference between the boss 662 and the complementary receptacle on the associated accessory device.

Figure 7:
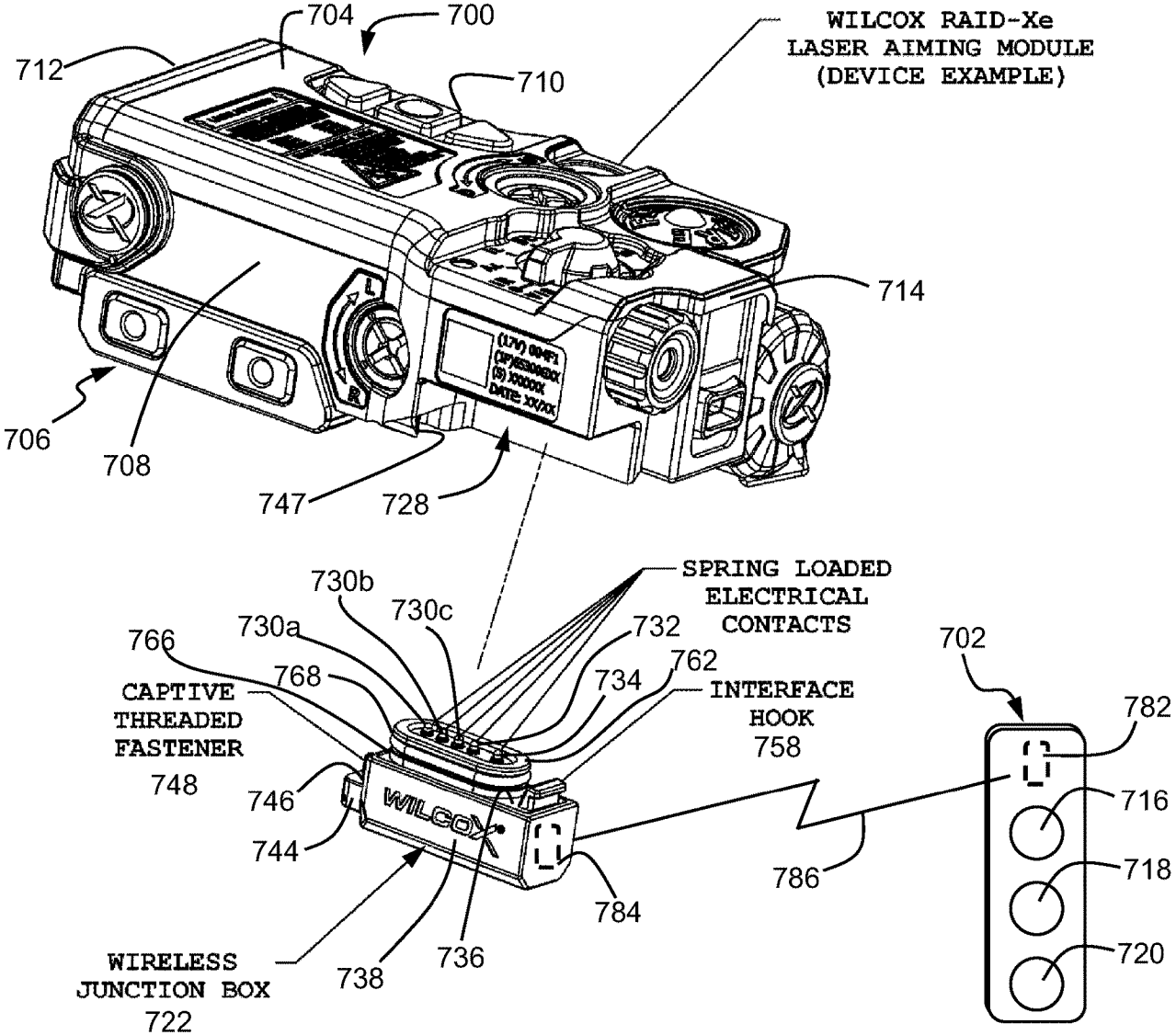
FIG. 7 is an isometric assembly view of a weapon accessory device having a remote control junction box interface in accordance with a sixth exemplary embodiment.

Referring now to FIG. 7, there appears a further embodiment weapon accessory device 700 operative to be coupled to a wireless remote control unit 702. The accessory device 700 includes a housing 704 defining an enclosure or shell containing the internal components of the accessory device 700. A rail clamp assembly 706 is provided for releasably attaching the unit 700 to an accessory mounting rail of a weapon (not shown), such as Picatinny rail (e.g., MIL-STD-1913 accessory rails, STANAG 2324 accessory rails, or the like), which are well understood by persons skilled in the art.

The accessory device 700 generally defines a footprint having a lateral extent defined by the left and right sides 708, 710, respectively, of the unit 700 and an axial extent defined by the front and rear sides 712, 714, respectively, of the unit 700.

The remote control unit 702 includes one or more manually actuatable elements, such as one or more keys, switches, or pressure pad sensors 716, 718, 720 and includes a wireless, e.g., radio frequency (RF) transmitter or transceiver 782 configured to transmit a wireless control signal 786 to a wireless receiver or transceiver 784 disposed within a wireless junction box 722. The junction box 722 includes a housing 726 attachable to the housing 704. In embodiments, the housing 726 is removably attachable to the housing 704. In embodiments, the housing 704 includes a recess or notch 728 which is sized to accommodate the junction box housing 726 such that the junction box housing is disposed within the footprint defined by the accessory housing 704. In embodiments, the signal from the remote control unit 702 are transmitted via a suitable wireless protocol, such as Bluetooth for user control of the accessory device 700. In embodiments, the Bluetooth link can also serve as a bridge to a computer based information handling system which may then connect to a network such as a Wi-Fi (802.11 compliant) network.

Electrical contact pins 730*a*, 730*b*, 730*c*, 732, and 734 contact a respective electrical contact pad on the accessory device 700 within the receptacle 728 to transmit control signals 786 from the wireless transceiver 782 to the wireless transceiver 784. The electrical contact pads are disposed within a sealed insulator on the device 700 as detailed above which is configured to resist entry of moisture or environmental contamination. The electrical contact pads, in turn, are in electrical communication with the electrical and/or electronic components of the accessory device 700.

In embodiments, the housing 726 includes an inner housing shell 736, which may be molded, e.g., injection molded, of a polymer material. The inner housing shell 736 is encased within an overmolded jacket 738. The junction box shell 736 includes a tab 744 having a through bore 746 receiving a captive rotatable threaded fastener 748 for securing the junction box 722 to the accessory device 700 as detailed above. The tab 744 is received within a complementary recess 747 in the accessory device 700. The threaded fastener 748 is aligned with a threaded opening on the accessory device 700. The junction box shell 736 further includes an interface hook 758 engaging a complementary receptacle in the accessory device 700 to provide an additional point of attachment, as described above.

The junction box shell 736 further includes an upstanding boss 762 having a plurality of openings receiving the pins 730*a*, 730*b*, 730*c*, 732, and 734. The boss 762 is received within a complementary receptacle on the accessory device 700, as described above. An annular channel 766 is formed on the boss 762. An O-ring or gasket 768 is received within the channel 766 and is configured to provide a sealing interference between the boss 762 and the corresponding receptacle on the device 700.

Figure 8:
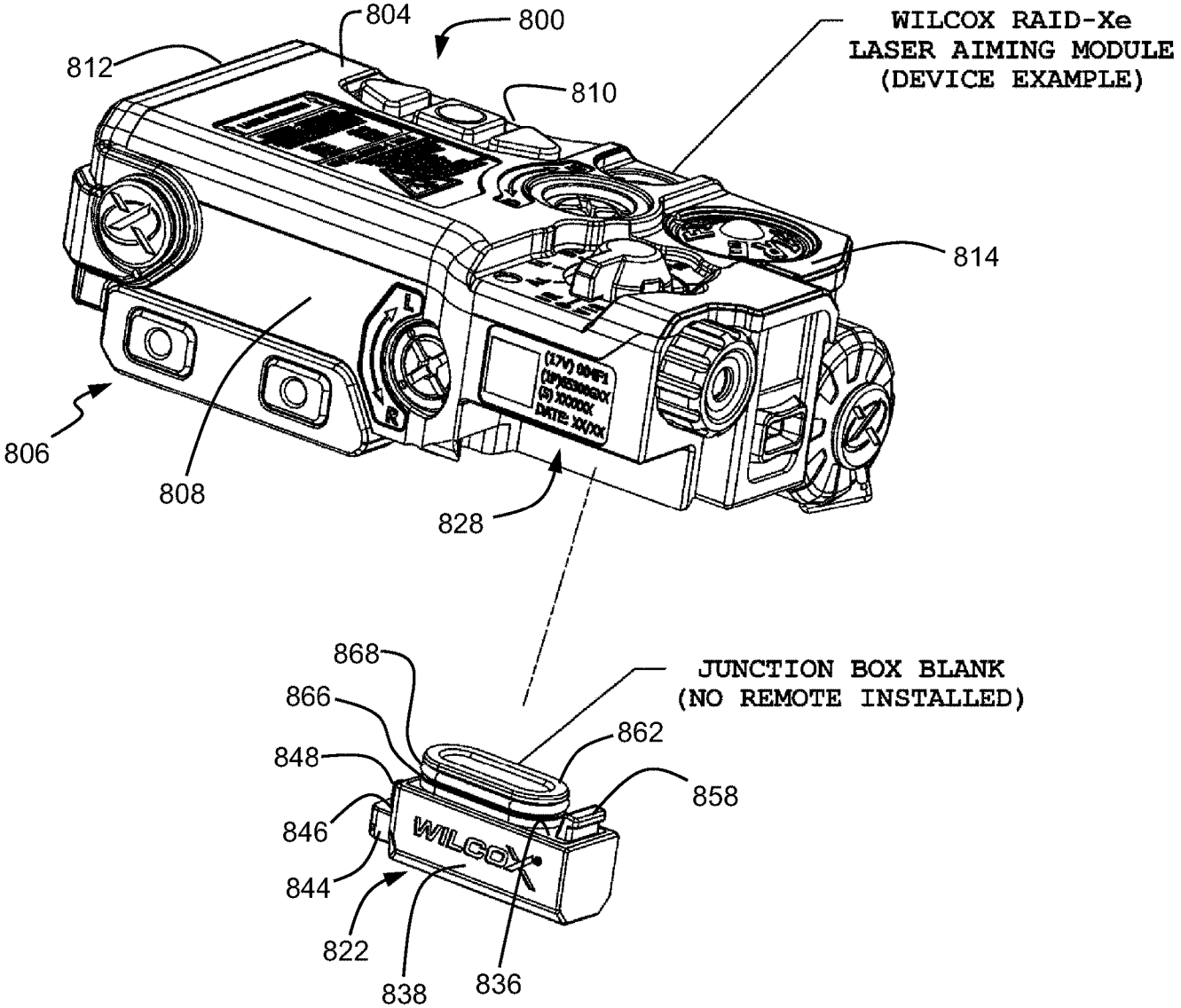
FIG. 8 is an isometric assembly view of a weapon accessory device having a remote control junction box blank installed in place of a remote control junction box.

Referring now to FIG. 8, there appears a further embodiment weapon accessory device 800 operative to be coupled to the accessory device 800 when the unit 800 is not being used with a remote control. The accessory device 800 includes a housing 804 defining an enclosure or shell containing the internal components of the accessory device 800. A rail clamp assembly 806 is provided for releasably attaching the unit 800 to an accessory mounting rail of a weapon (not shown), such as Picatinny rail (e.g., MIL-STD-1913 accessory rails, STANAG 2324 accessory rails, or the like), which are well understood by persons skilled in the art.

The accessory device 800 generally defines a footprint having a lateral extent defined by the left and right sides 808, 810, respectively, of the unit 800 and an axial extent defined by the front and rear sides 812, 814, respectively, of the unit 800. A blank junction box 822 is includes a housing 826 attachable to the housing 804. In embodiments, the housing 826 is removably attachable to the housing 804. In embodiments, the housing 804 includes a recess or notch 828 which is sized to accommodate the blank junction box housing 826 such that the junction box housing is disposed within the footprint defined by the accessory housing 804.

In embodiments, the housing 826 includes an inner housing shell 836, which may be molded, e.g., injection molded, of a polymer material. The inner housing shell 836 is encased within an overmolded jacket 838. The blank junction box shell 836 includes a tab 844 having a through bore 846 receiving a captive rotatable threaded fastener 848 for securing the junction box 822 to the accessory device 800 as detailed above. The tab 844 is received within a complementary recess 847 in the accessory device 800. The threaded fastener 848 is aligned with a threaded opening on the accessory device 800. The junction box shell 836 further includes an interface hook 858 engaging a complementary receptacle in the accessory device 800 to provide an additional point of attachment, as described above.

The junction box shell 836 further includes an upstanding boss 862 received within a complementary receptacle on the accessory device 800, as described above. An annular channel 866 is formed on the boss 862. An O-ring or gasket 868 is received within the channel 866 and is configured to provide a sealing interference between the boss 862 and the corresponding receptacle on the device 800.

Figure 9:
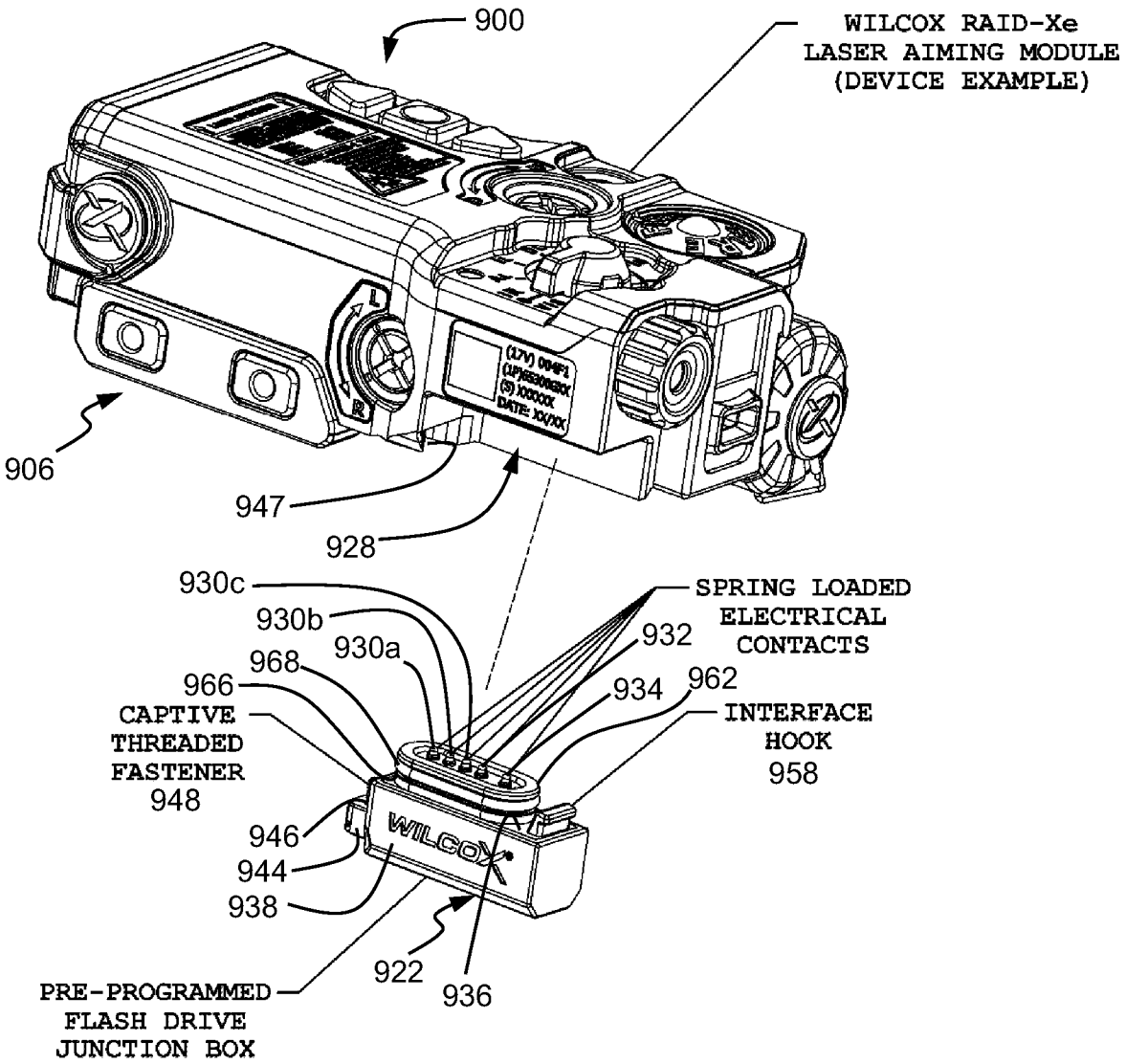
FIG. 9 is an isometric assembly view of a weapon accessory device having a flash drive module attachable in place of a remote control junction box.

Referring now to FIG. 9, there appears a further embodiment weapon accessory device 900 operative to be coupled to preprogrammed electronic storage memory device such as a Flash drive 922 which occupies a receptacle 928 in place of a remote control junction box. In embodiments, the memory storage junction box 922 is configured to receive data representative of one or more user preferences or presets, e.g., via a user input on the unit 900 input. The data representative of such user preferences or presets preference is stored in the memory of the memory storage junction box 922 and is available for recall to set one or more parameters or otherwise configure the accessory device in accordance with the stored one or more user preferences or presets in accordance with the user's personal preferences for subsequent uses of the accessory device 900.

The accessory device 900 includes a housing 904 defining an enclosure or shell containing the internal components of the accessory device 900. A rail clamp assembly 906 is provided for releasably attaching the unit 900 to an accessory mounting rail of a weapon (not shown), such as Picatinny rail (e.g., MIL-STD-1913 accessory rails, STANAG 2324 accessory rails, or the like), which are well understood by persons skilled in the art.

The accessory device 900 generally defines a footprint having a lateral extent defined by the left and right sides 908, 910, respectively, of the unit 900 and an axial extent defined by the front and rear sides 912, 914, respectively, of the unit 900. The memory storage junction box 922 includes a housing 926 attachable to the housing 904. In embodiments, the housing 926 is removably attachable to the housing 904. In embodiments, the housing 904 includes a recess or notch 928 which is sized to accommodate the memory storage junction box housing 926 such that the junction box housing is disposed within the footprint defined by the accessory housing 904. Electrical contact pins 930*a*, 930*b*, 930*c*, 932, and 934 each contact a respective electrical contact pad on the accessory device 900 within the receptacle 928 to operably couple a nonvolatile electronic memory within the junction box 922 to a processing system of the accessory device 900. The electrical contact pads are disposed within a sealed insulator on the device 900 as detailed above which is configured to resist entry of moisture or environmental contamination. The electrical contact pads, in turn, are in electrical communication with the computer processing components of the accessory device 900.

In embodiments, the housing 926 includes an inner housing shell 936, which may be molded, e.g., injection molded, of a polymer material. The inner housing shell 936 is encased within an overmolded jacket 938. The junction box shell 936 includes a tab 944 having a through bore 946 receiving a captive rotatable threaded fastener 948 for securing the junction box 922 to the accessory device 900 as detailed above. The tab 944 is received within a complementary recess 947 in the accessory device 900. The threaded fastener 948 is aligned with a threaded opening on the accessory device 900. The junction box shell 936 further includes an interface hook 958 engaging a complementary receptacle in the accessory device 900 to provide an additional point of attachment, as described above.

The junction box shell 936 further includes an upstanding boss 962 having a plurality of openings receiving the pins 930*a*, 930*b*, 930*c*, 932, and 934. The boss 962 is received within a complementary receptacle on the accessory device 900, as described above. An annular channel 966 is formed on the boss 962. An O-ring or gasket 968 is received within the channel 966 and is configured to provide a sealing interference between the boss 962 and the corresponding receptacle on the device 900.

In embodiments, some or all of the junction boxes 122, 222, 322, 422, 522, 622, 722, 822, and 922 are interchangeably attachable to a weapon accessory device in place of each other.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A junction box for a weapon accessory device, the junction box for electrically coupling a remote control unit to the weapon accessory device, the remote control unit having one or more manually actuatable switches, the junction box comprising:

a housing having a mounting face and a connection face, wherein the mounting face is configured to face a complementary mounting surface of the weapon accessory device when the junction box is mounted to the weapon accessory device, and wherein the connection face is configured to couple to an electrical cable electrically coupled to the remote control unit;

a plurality of electrical conductors held within the housing, the plurality of electrical conductors comprising mating contact portions disposed at the mounting face and configured to contact aligned contacts on the weapon accessory device;

wherein the connection face extends parallel to and is substantially aligned with a rear surface of the weapon accessory device when the junction box is mounted to the weapon accessory device; and wherein the housing has a bottom face opposite the mounting face, wherein the bottom face extends parallel to and is substantially aligned with a bottom surface of the weapon accessory device when the junction box is mounted to the weapon accessory device.

2. The junction box of claim 1, wherein the housing has opposing first and second side faces extending between the mounting face and the bottom face, wherein one of the first and second side faces extends parallel to and is substantially aligned with a side surface of the weapon accessory device when the junction box is mounted to the weapon accessory device.

3. The junction box of claim 1, wherein the connection face comprises a first electrical connector configured to mate with a complementary second electrical connector on the remote control unit.

4. The junction box of claim 1, wherein the connection face comprises an aperture receiving an end of the electrical cable, wherein the electrical cable comprises a plurality of electrically conductive elements, each of the electrically conductive elements being hard wired to a respective one of said plurality of electrical conductors held within the housing.

5. The junction box of claim 1, wherein mating contact portions protrude from the mounting face.

6. The junction box of claim 1, further comprising a radio frequency receiver configured to receive a wireless control signal from the remote control unit.

7. The junction box of claim 1, wherein the junction box is substantially entirely within a footprint of the weapon accessory device when the junction box is mounted to the weapon accessory device.

8. A junction box for a weapon accessory device, the junction box for electrically coupling a remote control unit to the weapon accessory device, the remote control unit having one or more manually actuatable switches, the junction box comprising:

a housing having a mounting face and a connection face, wherein the mounting face is configured to face a complementary mounting surface of the weapon accessory device when the junction box is mounted to the weapon accessory device, and wherein the connection face is configured to couple to an electrical cable electrically coupled to the remote control unit;

a plurality of electrical conductors held within the housing, the plurality of electrical conductors comprising mating contact portions disposed at the mounting face and configured to contact aligned contacts on the weapon accessory device; and wherein the housing has a bottom face opposite the mounting face, wherein the bottom face extends parallel to and is substantially aligned with a bottom surface of the weapon accessory device when the junction box is mounted to the weapon accessory device.

9. The junction box of claim 8, wherein the housing has opposing first and second side faces extending between the mounting face and the bottom face, wherein one of the first and second side faces extends parallel to and is substantially aligned with a side surface of the weapon accessory device when the junction box is mounted to the weapon accessory device.

10. The junction box of claim 8, wherein the connection face comprises a first electrical connector configured to mate with a complementary second electrical connector on the remote control unit.

11. The junction box of claim 8, wherein the connection face comprises an aperture receiving an end of the electrical cable, wherein the electrical cable comprises a plurality of electrically conductive elements, each of the electrically conductive elements being hard wired to a respective one of said plurality of electrical conductors held within the housing.

12. The junction box of claim 8, wherein mating contact portions protrude from the mounting face.

13. The junction box of claim 8, further comprising a radio frequency receiver configured to receive a wireless control signal from the remote control unit.

14. The junction box of claim 8, wherein the junction box is substantially entirely within a footprint of the weapon accessory device when the junction box is mounted to the weapon accessory device.

15. A junction box for a weapon accessory device, the junction box for electrically coupling a remote control unit to the weapon accessory device, the remote control unit having one or more manually actuatable switches, the junction box comprising:

a housing having a mounting face and a connection face, wherein the mounting face is configured to face a complementary mounting surface of the weapon accessory device when the junction box is mounted to the weapon accessory device, and wherein the connection face is configured to couple to an electrical cable electrically coupled to the remote control unit;

a plurality of electrical conductors held within the housing, the plurality of electrical conductors comprising mating contact portions disposed at the mounting face and configured to contact aligned contacts on the weapon accessory device; and a tab extending from a front face of the housing, the front face opposite the connection face, the tab receiving a threaded fastener for securing the junction box to the weapon accessory device.

16. The junction box of claim 15, further comprising a hook extending from the mounting face of the housing, the hook releasably engaging a complementary channel on the weapon accessory device when the junction box is mounted to the weapon accessory device.

17. The junction box of claim 15, wherein the connection face comprises a first electrical connector configured to mate with a complementary second electrical connector on the remote control unit.

18. The junction box of claim 15, wherein the connection face comprises an aperture receiving an end of the electrical cable, wherein the electrical cable comprises a plurality of electrically conductive elements, each of the electrically conductive elements being hard wired to a respective one of said plurality of electrical conductors held within the housing.

19. The junction box of claim 15, wherein mating contact portions protrude from the mounting face.

20. The junction box of claim 15, further comprising a radio frequency receiver configured to receive a wireless control signal from the remote control unit.

21. The junction box of claim 15, wherein the junction box is substantially entirely within a footprint of the weapon accessory device when the junction box is mounted to the weapon accessory device.

22. A junction box for a weapon accessory device, the junction box for electrically coupling a remote control unit to the weapon accessory device, the remote control unit having one or more manually actuatable switches, the junction box comprising:

a housing having a mounting face and a connection face, wherein the mounting face is configured to face a complementary mounting surface of the weapon accessory device when the junction box is mounted to the weapon accessory device, and wherein the connection face is configured to couple to an electrical cable electrically coupled to the remote control unit;

a plurality of electrical conductors held within the housing, the plurality of electrical conductors comprising mating contact portions disposed at the mounting face and configured to contact aligned contacts on the weapon accessory device; and a blank junction box configured to attach to the weapon accessory device in place of the junction box when the remote control unit is not in use.

23. The junction box of claim 22, wherein the blank junction box is substantially within a footprint of the weapon accessory device when the blank junction box is mounted to the weapon accessory device.

24. The junction box of claim 22, wherein the connection face comprises a first electrical connector configured to mate with a complementary second electrical connector on the remote control unit.

25. The junction box of claim 22, wherein the connection face comprises an aperture receiving an end of the electrical cable, wherein the electrical cable comprises a plurality of electrically conductive elements, each of the electrically conductive elements being hard wired to a respective one of said plurality of electrical conductors held within the housing.

26. The junction box of claim 22, wherein mating contact portions protrude from the mounting face.

27. The junction box of claim 22, further comprising a radio frequency receiver configured to receive a wireless control signal from the remote control unit.

28. The junction box of claim 22, wherein the junction box is substantially entirely within a footprint of the weapon accessory device when the junction box is mounted to the weapon accessory device.

29. A junction box for a weapon accessory device, the junction box for electrically coupling a remote control unit to the weapon accessory device, the remote control unit having one or more manually actuatable switches, the junction box comprising:

a housing having a mounting face and a connection face, wherein the mounting face is configured to face a complementary mounting surface of the weapon accessory device when the junction box is mounted to the weapon accessory device, and wherein the connection face is configured to couple to an electrical cable electrically coupled to the remote control unit;

a plurality of electrical conductors held within the housing, the plurality of electrical conductors comprising mating contact portions disposed at the mounting face and configured to contact aligned contacts on the weapon accessory device; and an electronic memory storage device configured to attach to the weapon accessory device in place of the junction box when the remote control unit is not in use.

30. The junction box of claim 29, wherein the electronic memory storage device is substantially within a footprint of the weapon accessory device when the electronic memory storage device is mounted to the weapon accessory device.

31. The junction box of claim 29, wherein the connection face comprises a first electrical connector configured to mate with a complementary second electrical connector on the remote control unit.

32. The junction box of claim 29, wherein the connection face comprises an aperture receiving an end of the electrical cable, wherein the electrical cable comprises a plurality of electrically conductive elements, each of the electrically conductive elements being hard wired to a respective one of said plurality of electrical conductors held within the housing.

33. The junction box of claim 29, wherein mating contact portions protrude from the mounting face.

34. The junction box of claim 29, further comprising a radio frequency receiver configured to receive a wireless control signal from the remote control unit.

35. The junction box of claim 29, wherein the junction box is substantially entirely within a footprint of the weapon accessory device when the junction box is mounted to the weapon accessory device.

* * * * *